US008201376B2

(12) United States Patent
Witcher

(10) Patent No.: US 8,201,376 B2
(45) Date of Patent: Jun. 19, 2012

(54) DRY-STACK MASONRY SYSTEM

(76) Inventor: Steve D. Witcher, Petaluma, CA (US)

( * ) Notice: Subject to any disclaimer, the term of this patent is extended or adjusted under 35 U.S.C. 154(b) by 0 days.

(21) Appl. No.: 12/875,985

(22) Filed: Sep. 3, 2010

(65) Prior Publication Data

US 2011/0047921 A1 Mar. 3, 2011

Related U.S. Application Data

(60) Provisional application No. 61/239,659, filed on Sep. 3, 2009.

(51) Int. Cl.

| | |
|---|---|
| ***E04B 1/02*** | (2006.01) |
| ***E04B 5/04*** | (2006.01) |
| ***E04B 2/00*** | (2006.01) |
| ***E04C 3/30*** | (2006.01) |
| ***E04C 2/04*** | (2006.01) |

(52) U.S. Cl. ..... 52/565; 52/607; 52/608; 52/592.1; 52/592.6; 52/574

(58) Field of Classification Search ..... 52/565, 52/604, 607, 608, 592.1, 592.6, 574
See application file for complete search history.

(56) References Cited

U.S. PATENT DOCUMENTS

| | | | | |
|---|---|---|---|---|
| 3,557,505 | A * | 1/1971 | Kaul | 52/275 |
| 4,896,999 | A * | 1/1990 | Ruckstuhl | 405/286 |
| 5,315,802 | A * | 5/1994 | Hart | 52/607 |
| 6,168,354 | B1 * | 1/2001 | Martin et al. | 405/284 |
| 6,205,735 | B1 | 3/2001 | Witcher | |
| 6,907,703 | B2 * | 6/2005 | Gonzalez | 52/604 |
| 7,497,646 | B2 * | 3/2009 | Price | 405/284 |
| 7,823,360 | B1 * | 11/2010 | Cottle | 52/608 |
| 8,015,772 | B2 * | 9/2011 | Jensen | 52/574 |
| 2008/0256894 | A1 * | 10/2008 | Marsh et al. | 52/719 |
| 2011/0072751 | A1 * | 3/2011 | Clear et al. | 52/415 |

* cited by examiner

*Primary Examiner* — Mark Wendell

(74) *Attorney, Agent, or Firm* — Craig M. Stainbrook; Stainbrook & Stainbrook, LLP

(57) ABSTRACT

A masonry block and hardware set for constructing dry stack walls and columns, including a wall unit, a corner unit, and an end unit, wherein each of the wall, corner, and end units have a top surface with a depression that is brought into substantial alignment when an adjoining block at the same level or in the same course is abutted with the respective unit, and further wherein when any two of the units are adjoined, the units create a vertically oriented space for accommodated clamping hardware, and further wherein each of the end and corner units include an alignment slot to align the end units and the corner units in relation to adjoining wall units. Clamping hardware is employed to bolt the wall while construction proceeds, the hardware being disposed in the masonry unit depressions and in the vertically oriented space created by stacked units. The clamping provides a downwardly directed compressive force and lateral rigidity.

8 Claims, 12 Drawing Sheets

DRY-STACK MASONRY SYSTEM

CROSS REFERENCES TO RELATED APPLICATIONS

The present application claims the benefit of the filing date of U.S. Provisional Patent Application Ser. No. 61/239,659, filed Sep. 3, 2009 (Sep. 3, 2009).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

SEQUENCE LISTING

Not applicable.

BACKGROUND OF THE INVENTION

1. Field of the Invention

The present invention relates to monolithic block-shaped wall construction units, such as masonry blocks, and more specifically to an improved stackable wall and column construction units adapted for use in constructing dry-stackable structures.

2. Discussion of Related Art Including Information Disclosed Under 37 CFR §§1.97, 1.98

The art of building dry stack stone walls is ancient and therefore highly developed. Even so, due to the high cost and difficulty of constructing walls of quarried stone or block, cast cementitious blocks long ago replaced quarried stone as a preferred material in many applications.

Cast blocks typically have a uniform size and shape, include at least one cavity, and frequently permit physical interlocking, either vertically or horizontally, with physical elements frequently integrally formed in the blocks. Such interlocking designs facilitate rapid assembly and proper alignment during fabrication. They also permit assembly without mortar, so that some designs of cast blocks may be employed for temporary walls that can be easily disassembled.

Dry stacked walls constructed of cast blocks may rely exclusively on the mass of the stacked blocks to maintain alignment and stability. However, mortarless cementitious cast block walls intended for permanent use usually require additional stability. Accordingly, many designs permit mortar or reinforced concrete to be poured or injected into and to fill gaps and aligned vertical and horizontal openings in the blocks.

However, along with their advantages, the known cast blocks also have many disadvantages, including: difficulty in converting the wall units into end or corner units; lateral instability; vulnerability of exposed mortar to chemical or environmental degradation; expansion and contraction of mortar, causing cracking and separation of blocks; difficulty in constructing curved configurations; and vulnerability of broad flat surfaces to defacement and graffiti.

Accordingly, the inventor of the present invention devised a mason wall cementitious building block system that is the described in U.S. Pat. No. 6,205,735, which is incorporated in its entirety by reference herein. The system disclosed therein comprises a wall and a corner unit making up a lightweight dry-stackable block unit system. Both wall units and corner/end units connect one to another in an interlocking fashion. The unit shapes and the method of assembling walls using such units provided several solutions to the problems then present in the prior art.

However, the improved block of the '735 patent was adapted for use with steel reinforcement bar and poured in concrete for structural stability and as a means to resist displacement of the stacked stones. This made any wall built with the inventive system necessarily permanent and essentially impossible to change or modify after and during construction without damaging the block material. Additionally, wall construction required labor skilled in the masonry and concrete trades.

The present invention represents a dramatic improvement over the technology described in the '735 by providing a simplified block that nevertheless provides equivalent structural integrity when dry stacked, but requires no interlocking pieces. Further, the inventive system employs a novel hardware system that facilitates rapid dry stack construction while providing significantly enhanced strength and stability over prior art designs.

BRIEF SUMMARY OF THE INVENTION

The inventive dry stack block units and hardware system for constructing walls using the block units is designed to provide an aesthetically appealing, upscale brick or block landscaping wall. The walls may be erected as freestanding fencing or as low retaining walls of four feet or less in height. The improved block design cooperates with a truly unique hardware system that creates an economical and simplified system for bolting the wall together as it is erected. The wall may be built upon and bolted to a poured-in-place concrete footing, which may be engineered for various heights and applications with site specific-conditions, or it may be built on a simple footing so as to enable a thorough dry stack construction and thereby allow post construction modification or wholesale dismantling.

It is a principal object of the present invention to provide a new and improved dry-stack masonry building unit which simplifies and reduces the cost of mold design. The simplification has downstream effects of creating cost savings in the initial mold construction, extending the life of the mold, and yielding improved production results with fewer defects and rejected units.

Another object of the present invention is to provide an improved dry-stack building unit that simplifies wall construction by eliminating any need for the use of interlocking units and which requires only that the units be butted together. This saves time and effort and reduces damage to the block units during construction.

A further object of the present invention is to provide a simplified block design that minimizes unit breakage from shipping and handling and facilitates stacking and transportation on pallets.

A still further object of the present invention is to provide an improved building unit designed for use with an inventive hardware system that enables the units to be quickly and easily bolted together in a more secure and economical assembly, while also facilitating unit easy and efficient means to align spacing the blocks.

Another object of the present invention is to provide a new and improved dry-stack masonry unit and system for using the same, wherein block cutting is minimized and need only be done in laying wall units in connection with corner units.

Yet another object of the present invention is to provide an improved dry-stack building unit in which wall construction is accomplished by stacking and bolting block units without the need for mortar. This is accomplished through the use of a novel hardware system, wherein a unique galvanized sheet metal bond strap provides three distinct and important structural and commercial advantages over conventional masonry assembly: First, the bond strap ties a wall system together, from end to end or from corner to corner. Second, it helps to align and space the individual building units, inasmuch as the bond strap fits snugly into the recessed area in the top of each unit. Third, it enables intermittent bolting of the wall assembly, and this greatly facilitates the assembly process, as well as providing greater seismic and structural stability. Other hardware elements, including a bolt plate, end ties, and corner ties, are an extension of the inventive bond strap concept and provide a novel fastening system for mortarless masonry. The novel hardware solves the problem of needing to manufacture the building units at minimal expense using standard and readily available equipment while also producing a stackable unit that can be assembled easily by unskilled laborers.

The objects and advantages set out above are achieved by providing a building unit and system of constructing walls and columns employs three principal blocks for the system, including a wall unit, a corner unit, and an end unit. Each have a simple shape that presents a clean outline for each wall, end and corner unit. The blocks are provided with depressions on their top sides that are instantly brought into substantial alignment when the blocks are abutted. The depth and area of depression in the top of each block unit then receives above-mentioned hardware for clamping the units in place as the construction proceeds. The clamping provides a downwardly directed compressive force and introduces lateral rigidity. The inventive design also incorporates a narrow slot stamped into the top of each unit which is used to secure permanent alignment of the end and corner units.

The improved block design may be provided in a wide range of standard sizes—e.g., four, six or eight inches in height—and may have various front surface contours, including split face, fluted or ribbed finishes. The units may be employed in either running bond or stacked bond assemblies.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

Accordingly, before explaining the preferred embodiment of the disclosure in detail, it is to be understood that the disclosure is not limited in its application to the details of the construction and the arrangements set forth in the following description or illustrated in the drawings. The inventive apparatus described herein is capable of other embodiments and of being practiced and carried out in various ways.

Also, it is to be understood that the terminology and phraseology employed herein are for descriptive purposes only, and not limitation. Where specific dimensional and material specifications have been included or omitted from the specification or the claims, or both, it is to be understood that the same are not to be incorporated into the appended claims, which will be presented at the time of filing a non-provisional patent application based on the instant application and claiming the benefit of its priority date.

As such, those skilled in the art will appreciate that the conception, upon which this disclosure is based may readily be used as a basis for designing other structures, methods, and systems for carrying out the several purposes of the present invention.

For a better understanding of the present invention, its advantages and the specific objects attained by its uses, reference should be made to the accompanying drawings and descriptive matter in which there are illustrated the preferred embodiment.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

LEGEND

Figure 1:
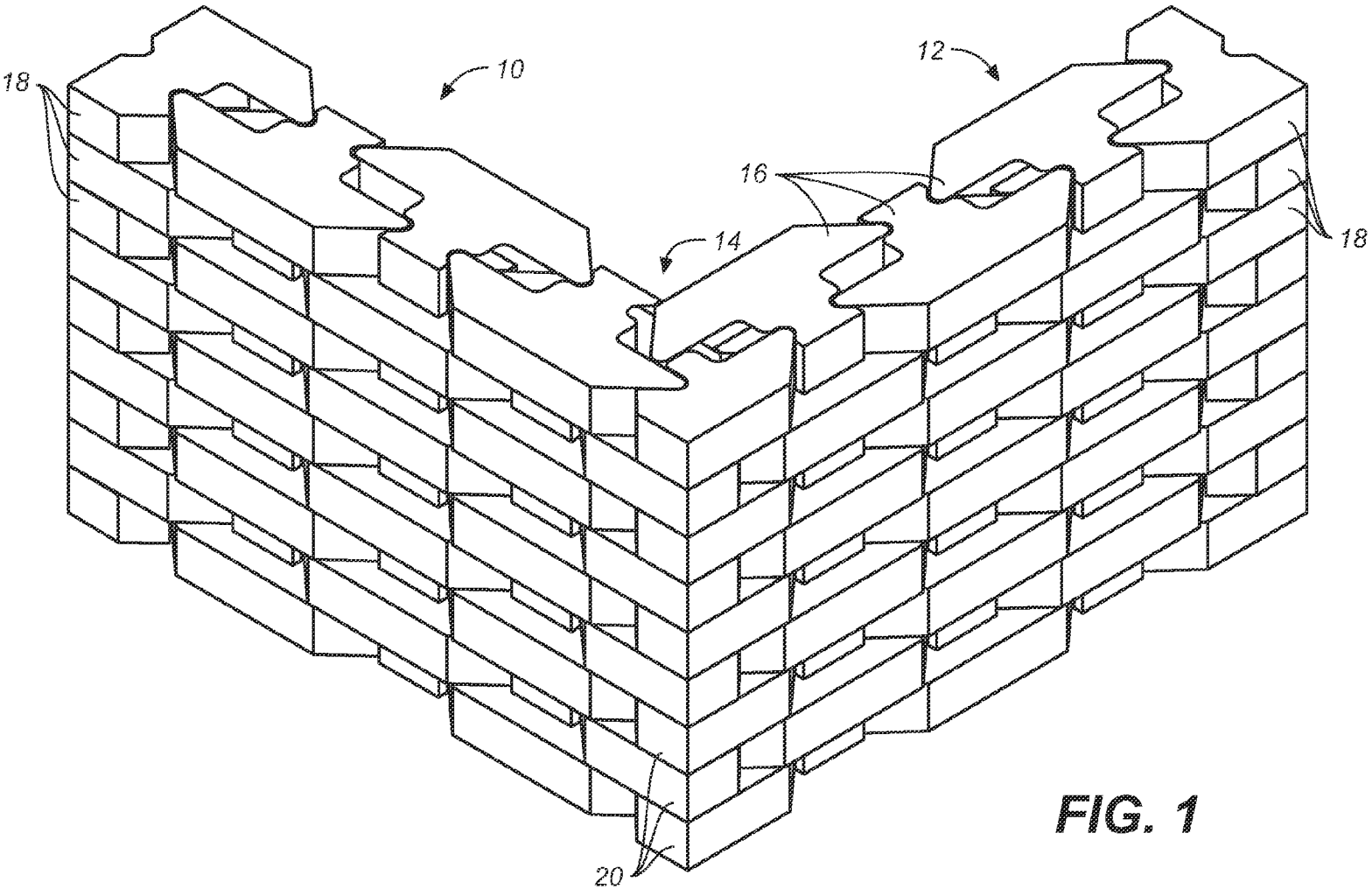
FIG. 1 is an upper perspective view top plan view showing a wall as constructing using the inventive dry-stack block units and hardware elements of the present invention.

FIGS. 1-4, Building Units: walls 10, 12, 90 degree corner 14, wall unit 16, end unit 18, corner units 20.

Wall unit 16: front face 22, front face width 24, back side 26, depth 28, angled sides 30, 32, rounded corners 34, 36, male body portion 38, central region 40, center line 42, wings 44, 46, female body portion 48, base portion 50, distal portion 52, concavities 54, 56, top surface 58, depression 60, 62, depression 64, rear face 66.

Corner unit 20, front face 70, inboard side 72, rear side portion 74, rear side portion 76, projection 78, surface 80, outboard side 82, slot 84, main body 86, rounded corner 88, wing 90 female concavity 92.

End unit 18, front face 100, outside face 102, recess 104, rear face 106, wing 108, angled side 110, rear side 112, outside face 102, rounded corner 114, triangular projection 116, first recessed area 118, second recessed portion 120, slot 122, female concavity 124.

FIGS. 5-12B—Hardware: Bond strap 130, hole 132, tab 134, bends 136.

Bolt plates 140, holes 142, 144, metal plate 146, hole 148, partial hole 150, thread-capture cut 152.

Corner bolt plates 160, diagonal slots 162, 164, right triangle halves 166, 168, bolt holes 170, center hole 171, crimps or cuts 172, diagonal corner cuts 174, corners 176, tabs 178.

End tie straps 180, holes 182, tabs 184.

Column plates 190, center hole 192, tabs 194.

Alternative corner plate 195, bolt holes 196, end cuts 197, corner cut 198, tabs 199, anchor bolts 200, concrete footing 202 space between back sides of units 210.

DETAILED DESCRIPTION OF THE INVENTION

Referring to FIGS. 1 through 12B, wherein like reference numerals refer to like components in the various views, there is illustrated therein a new and improved dry stack masonry system.

BLOCK UNITS: The inventive cementitious blocks and system for constructing walls using the same comprises, in the first instance, a unique combination of monolithic wall, corner, and end units. Two walls 10, 12, joined at a 90 degree corner 14, using the inventive system are shown in FIG. 1. As will be immediately appreciated from this view, a wall so constructed comprises three block units, including wall units 16, end units 18, and corner units 20.

Figure 2:
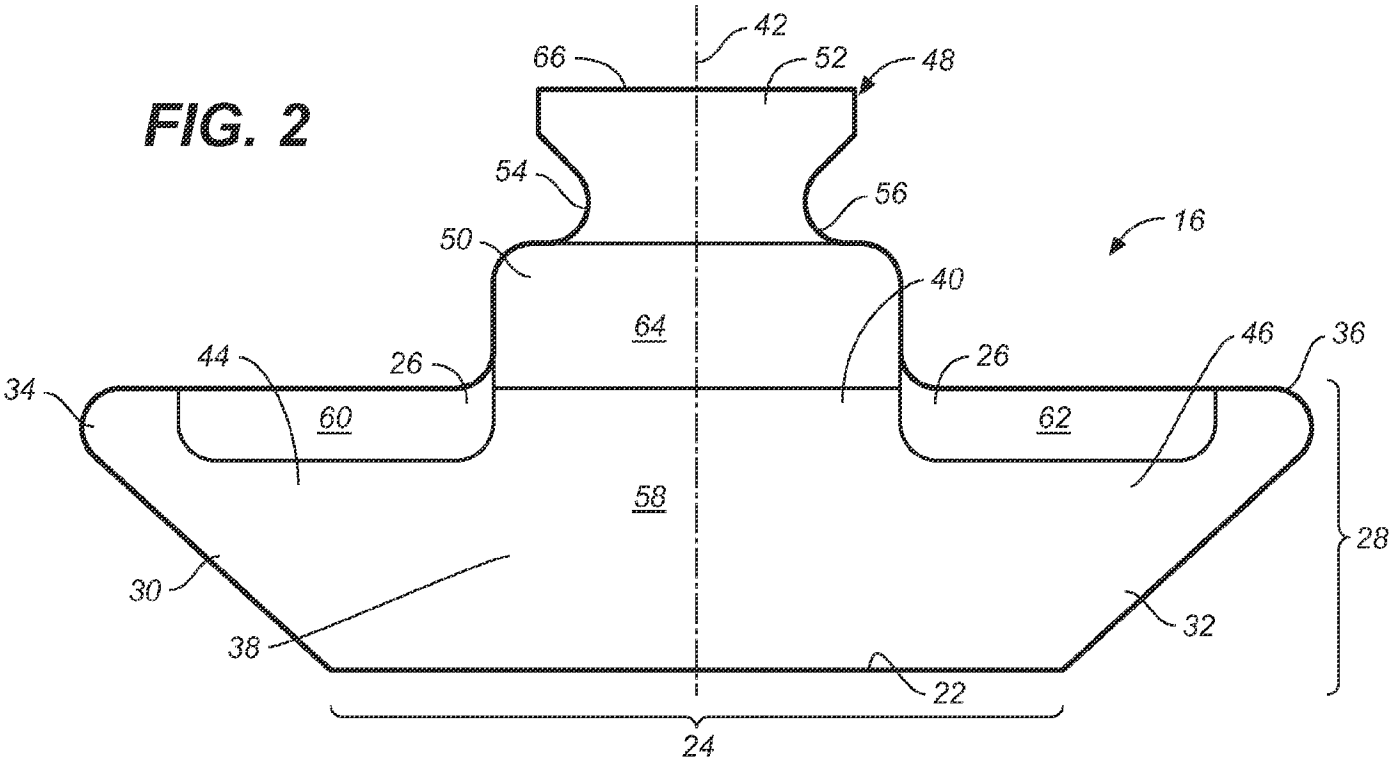
FIG. 2 is a top plan view of the primary monolithic block employed in the dry stack system of the present invention.
Figure 2A:
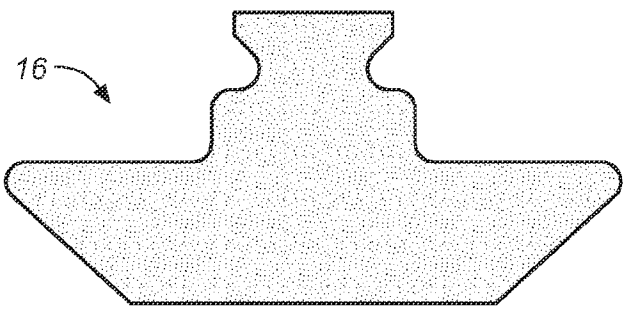
FIG. 2A is a bottom view thereof.

Referring now to FIGS. 2-2A, there is shown in schematic form a top plan view of the principle wall unit 16 of the inventive dry stack masonry block system. The wall unit includes a front face 22 having a front face width 24, a back side 26 and a depth 28 defined as the distance from the front face to the back side; and two angled sides 30, 32, each of which angle outwardly from the front face to join the back side at a rounded corner 34, 36. Collectively, these elements form a male body portion 38 having a central region 40 with a center line 42 bisecting the block into identical first and second halves. Two generally triangular wings 44, 46, each defined by an angled side and the rear side, extend outwardly from the central region. A female body portion 48 integrally formed in the monolithic block extends rearwardly from the central region of the male body portion and includes a base portion 50, a distal portion 52, and two concavities 54, 56, disposed between the base and distal portions and shaped to conform to and accommodate the corner of a male wing (with generally tight tolerances) in a block in a reverse orientation. It should be noted that only the top side of the units include recesses or depressions, as the bottom side of the blocks is preferably substantially planar.

Next, the wall unit includes a top surface 58 covering all portions and including a rectangular shaped depression 60, 62 in the surface of the rear area of each wing and a depression 64 on the entire surface of the base area. The depth of the depressions in the wings is greater than that of the depression in the base portion, in that the former accommodates a bolt plate and is disposed underneath a bond strap when installing the hardware system for connecting and securing the units. These elements are described in detail below.

Finally, the wall unit includes a rear face 66, which is disposed between the angled sides of adjoining blocks in a constructed wall.

Figure 3:
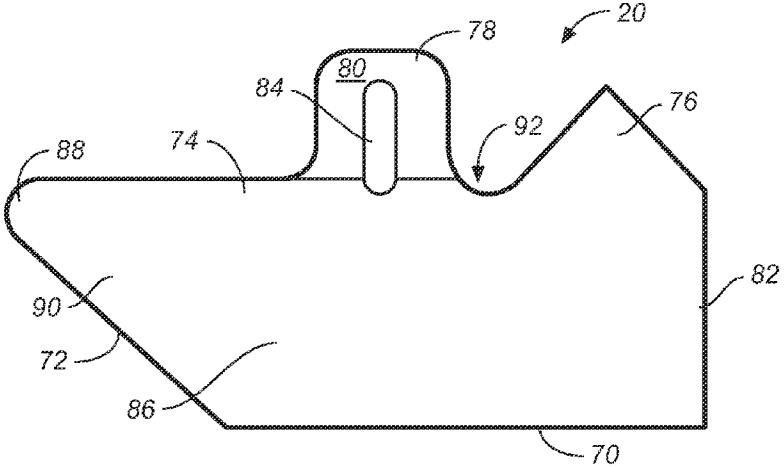
FIG. 3 is a top plan view of a corner block used in the inventive system.
Figure 3A:
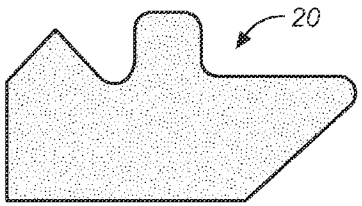

Referring now to FIG. 3, there is shown the corner unit 20 of the inventive dry stack masonry system. The corner unit includes a front face 70, and angled inboard side 72, a flat rear side portion 74, a triangular rear side portion 76, and a projection 78 extending rearward from the rear side and disposed between the flat rear side portion and the triangular rear side portion and having a surface 80 depressed to the same depth as the depressions 60, 62 in the wall unit. Opposite the angled inboard side 72 is a flat outboard side 82 which is substantially normal to the front face 70. A slot 84 is cut into the main body 86 of the block and extends into the projection 78 so as to accommodate a bend in the bond strap of the hardware. As with the wall unit, the corner unit includes an angled side that joins the rear side in a rounded corner 88 and the geometry defines a wing 90 for insertion into a female concavity in an adjoining block. Additionally, disposed between the projection 78 and the triangular rear portion 76 is a female concavity 92 shaped and sized to accommodate (with tight tolerances) the corner of a wing of a block disposed generally normal to the corner unit.

Figure 4:
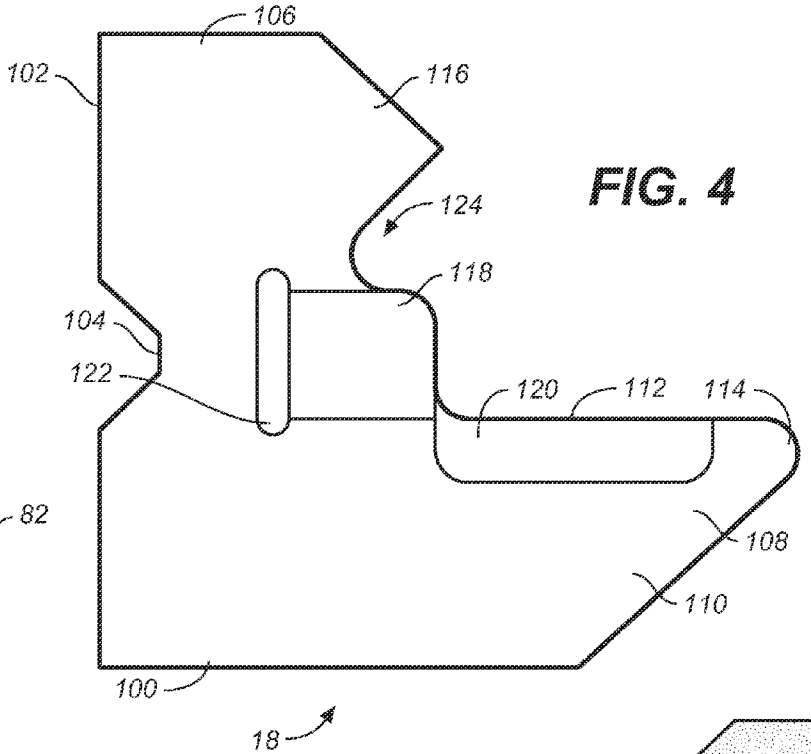
FIG. 4 is a top plan view of an end block.
Figure 4A:
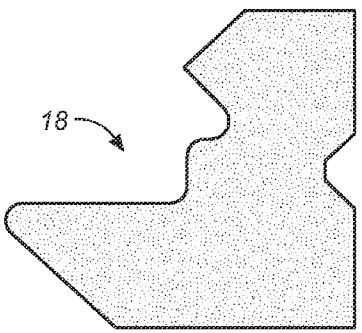
FIG. 4A is a bottom view thereof.

Next, and referring now to FIGS. 4-4A, there is shown an end unit 18, which includes a front face 100 (preferably flat), and outside face 102 (preferably contoured and including a trough-shaped recess 104 shaped to generally match in appearance to the recesses between the front faces of adjoining blocks in a constructed wall), and a rear face 106. A wing 108 is defined by an angled side 110 and a flat rear side 112 that is generally perpendicular to the outside face 102. The angled side and flat rear side join in a rounded corner 114, which, again, fits into a female concavity of an adjoining block. disposed between the wing and outside face 106 are a triangular projection 116, a first recessed area 118 for cradling the end of a bond strap, and a second recessed portion 120 for accommodating an edge of a bolt plate. The first recessed area terminates in a slot 122 which accepts a bent end of a bond strap. Disposed between the first depressed area 118 and the triangular projection 116 is a female concavity 124 matching its counterparts in the wall and corner units.

Hardware: The unique hardware system of the present invention minimally includes: (a) anchor bolts; (b) bond straps; (c) bolt plates (including corner bolt plates); (d) end tie straps; and (e) column plates.

Figure 10:
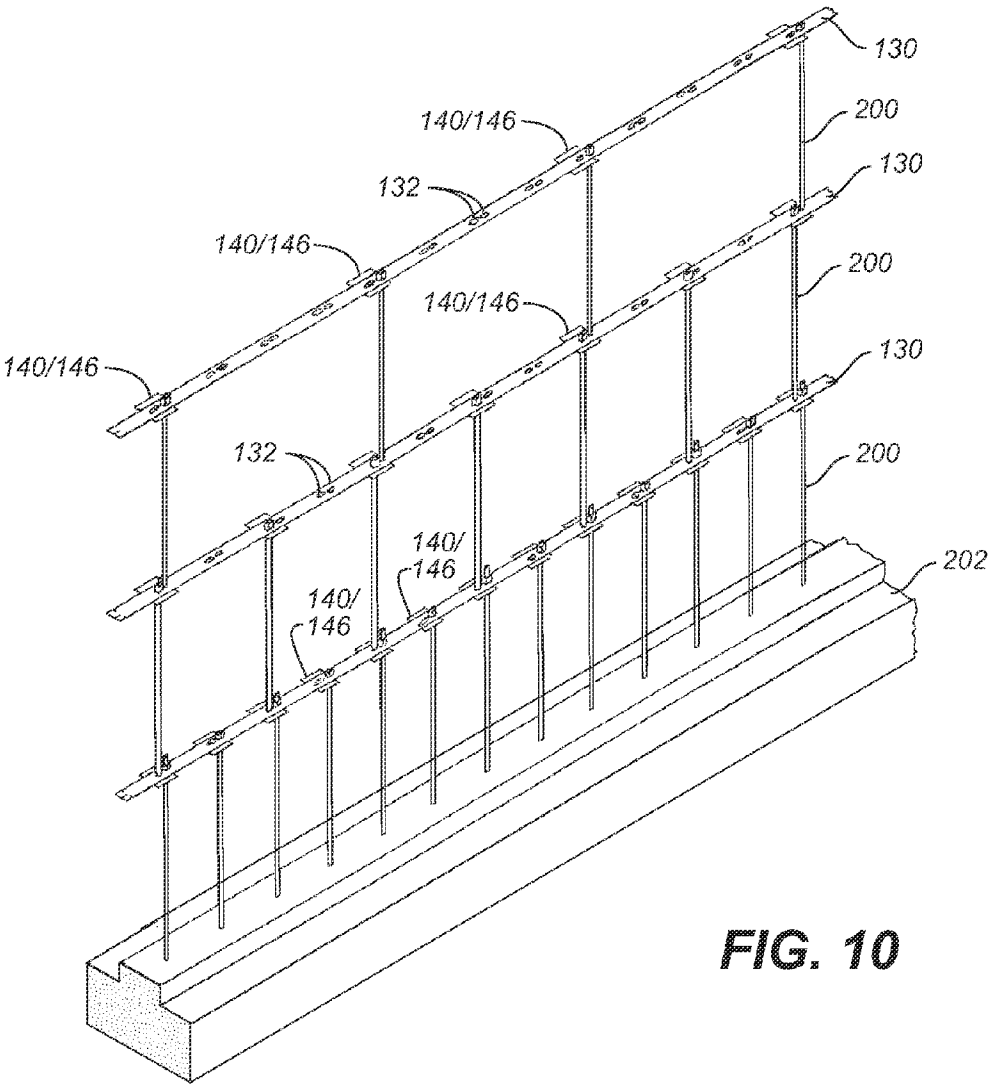
FIG. 10 is an upper left perspective view showing an assembled hardware layout for a typical six-foot high wall using the principal hardware elements employed in the inventive dry-stack masonry system of the present invention.
Figure 11A:
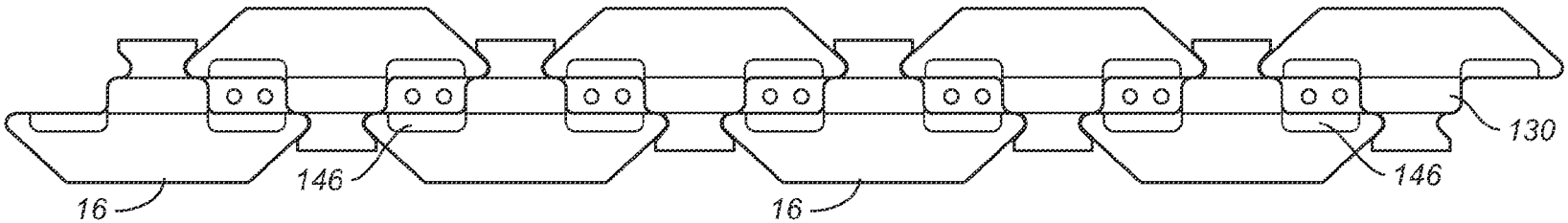
FIG. 11A is a top plan view showing the block and hardware configuration for a the interior portions of a simple wall.
Figure 11B:
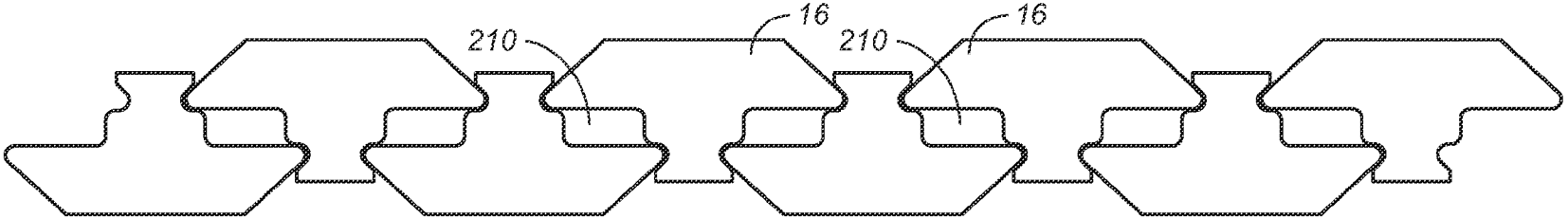
FIG. 11B is a bottom plan view thereof.
Figure 11C:
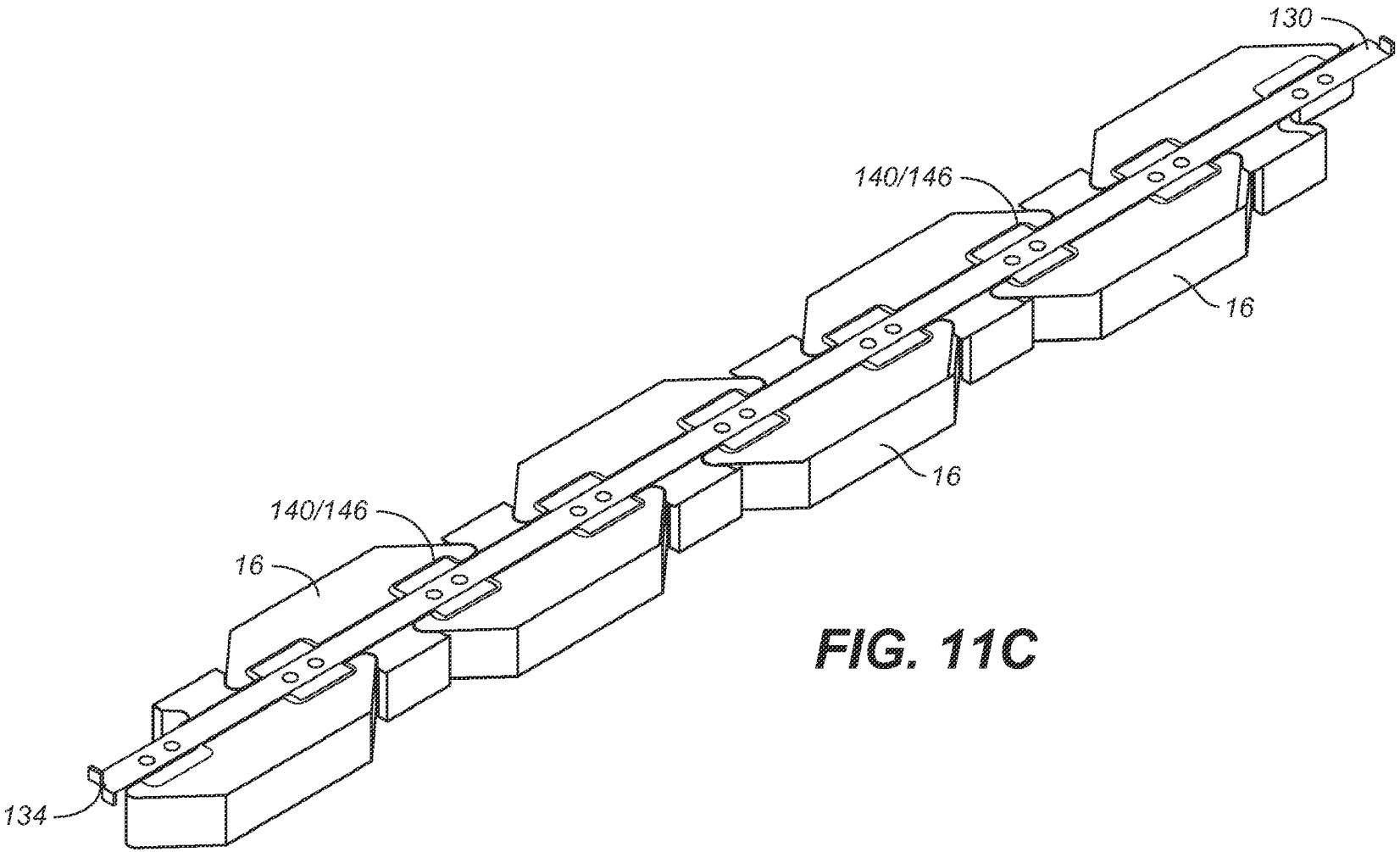
FIG. 11C is an upper perspective end view showing the inventive hardware installed over a single course in a wall under construction.

The above-referenced anchor bolts are shown in an assembled hardware layout in FIG. 10. Such J-bolts are well known in the art. For use in the present invention, they preferably comprise standard, off the shelf, ⅝" or ¾" diameter, 27-30" length, right angle bend anchor bolts, all thread rods and nuts.

Figure 5:
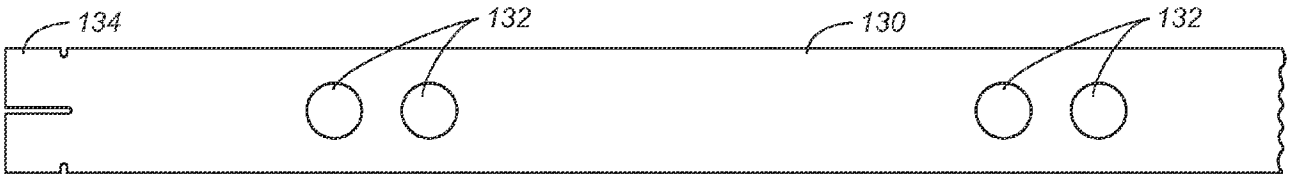
FIG. 5 is a top plan view of the bond strap of the hardware system of the present invention.
Figure 5B:
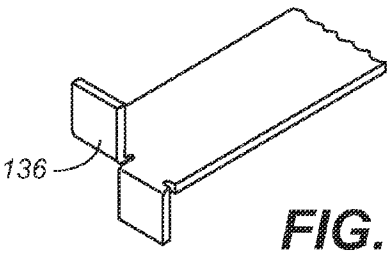
FIG. 5B shows how the tabs of the end of the bond strap can be bent upwardly or downwardly to engage the end blocks in a course of blocks.
Figure 5A:
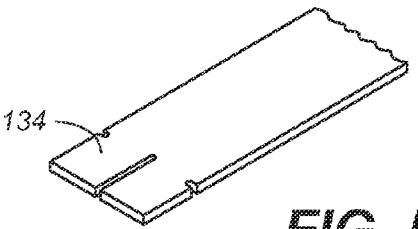
FIG. 5A is an upper perspective end view thereof.
Figure 6B:
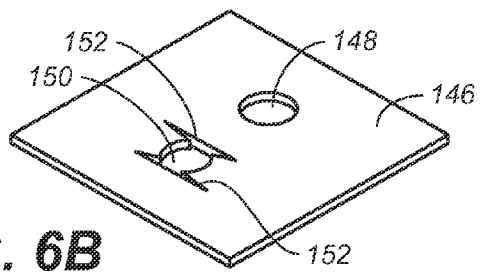
FIG. 6B is an alternative bolt plate fabricated from sheet metal.
Figure 6A:
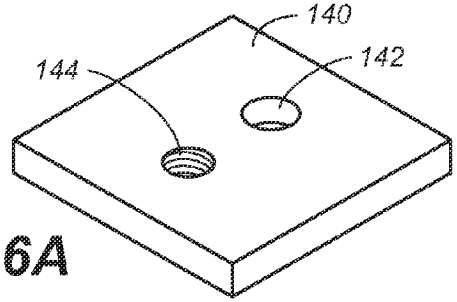
FIG. 6A is an upper perspective view of a steel bolt plate used in combination with bond straps and vertical support rods in the hardware system of the present invention.

The bond strap 130 is shown in FIGS. 5-5B, and preferably comprise an elongate, rectangular galvanized sheet metal bond strap, 1½"×113" straps of 16 gauge to 10 gauge thickness and having a pre-punched hole 132 and tab 134 pattern, the latter to form bends 136 for insertion into slots in blocks.

Next, and referring now to FIGS. 6A-8, the hardware system includes bolt plates 140, which preferably comprise 3"×3"×⅜" plates with one punched 11/16" diameter hole 142 and one drilled and threaded standard ⅝"×11 hole 144. Alternatively, and referring now FIG. 6B, the bolt plate may comprise a 3"×3"⅛" gauge sheet metal plate 146 with an 11/16" hole 148, and a partial hole 150 with a thread-capture cut 152.

Referring now to FIGS. 7A-D, corner bolt plates 160 comprise a ⅛" gauge sheet metal square with diagonal slots 162, 164, which facilitate breaking the plates in half to form two discrete right triangle halves 166, 168. Each half includes pre-drilled holes 170 for passing bolts, a center hole 171, crimps or small cuts 172 and diagonal cuts 174 at the vertices 176 of each triangle so as to form tabs 178 that enable easy bending of the corners for insertion into corner unit slots. In a manner well known in the art, slots 173 disposed on the diagonal and having bridges disposed therebetween define frangible lines and provide means for weakening the plate for breaking it into the halves described above by bending the plate along the diagonal line defined by the slots.

Figure 7B:
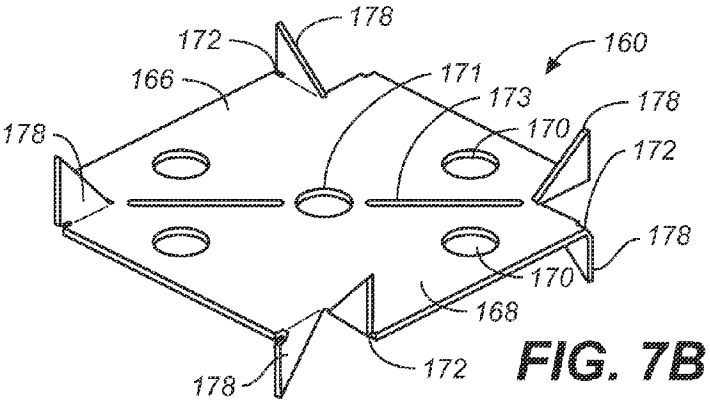
FIG. 7B is a top perspective view showing an intact corner plate with tabs bent for installation in the slots of corner units assembled as a column.
Figure 7A:
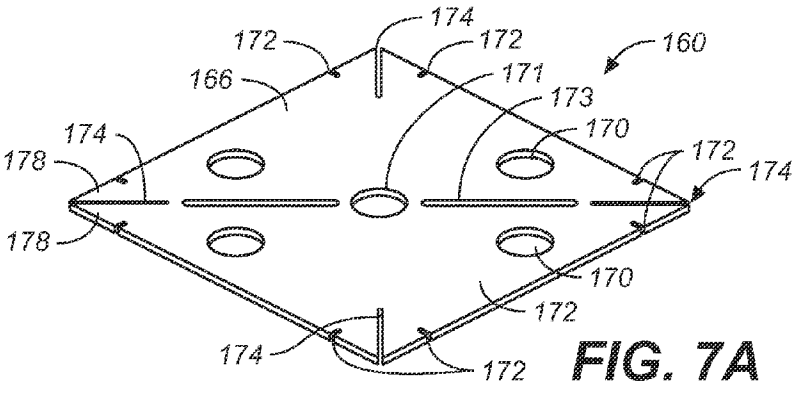
FIG. 7A is a top plan view of a corner plate.
Figure 7D:
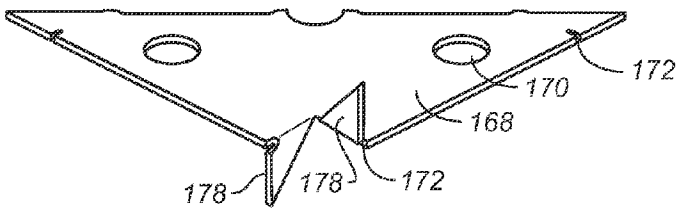
FIG. 7D is a top perspective view showing the corner plate of FIG. 7C with the corner tabs bent for insertion in block unit slots.
Figure 7C:
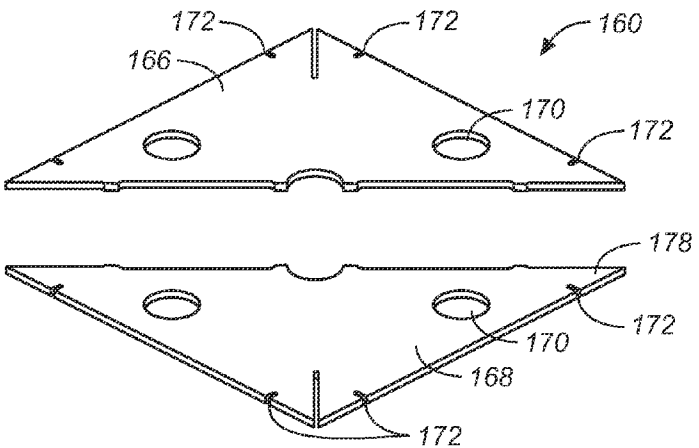
FIG. 7C is a top perspective view showing the corner plate of FIGS. 7A-B split into two halves.
Figure 7F:
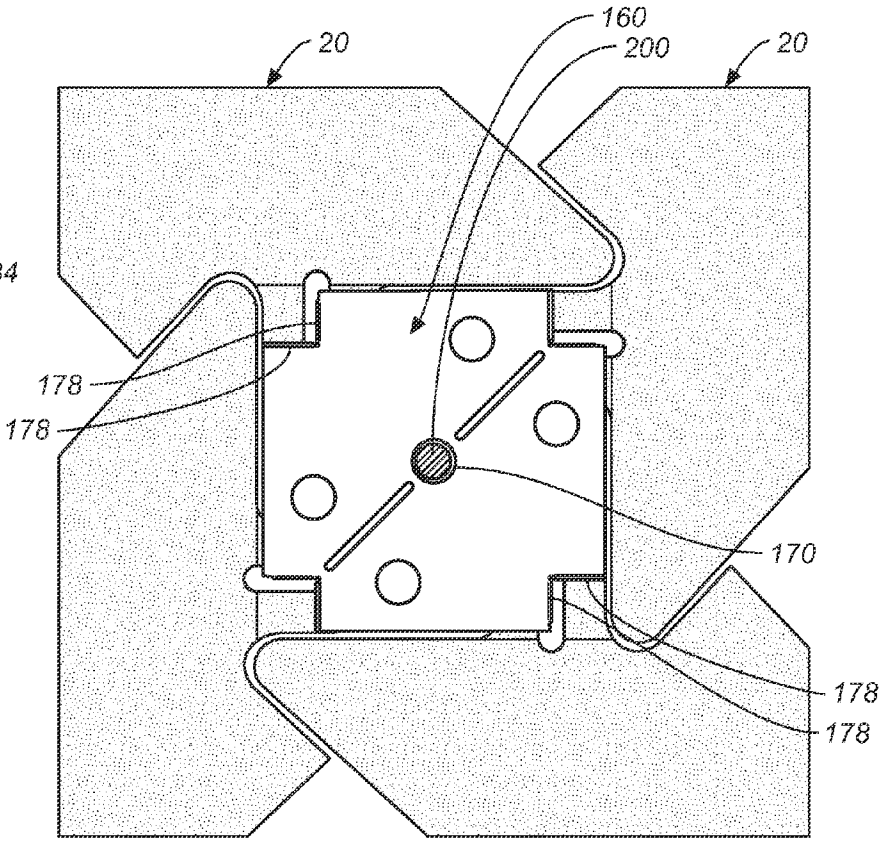
FIG. 7F shows the column of FIG. 7C after installation of the intact corner plate of FIG. 7A.
Figure 7E:
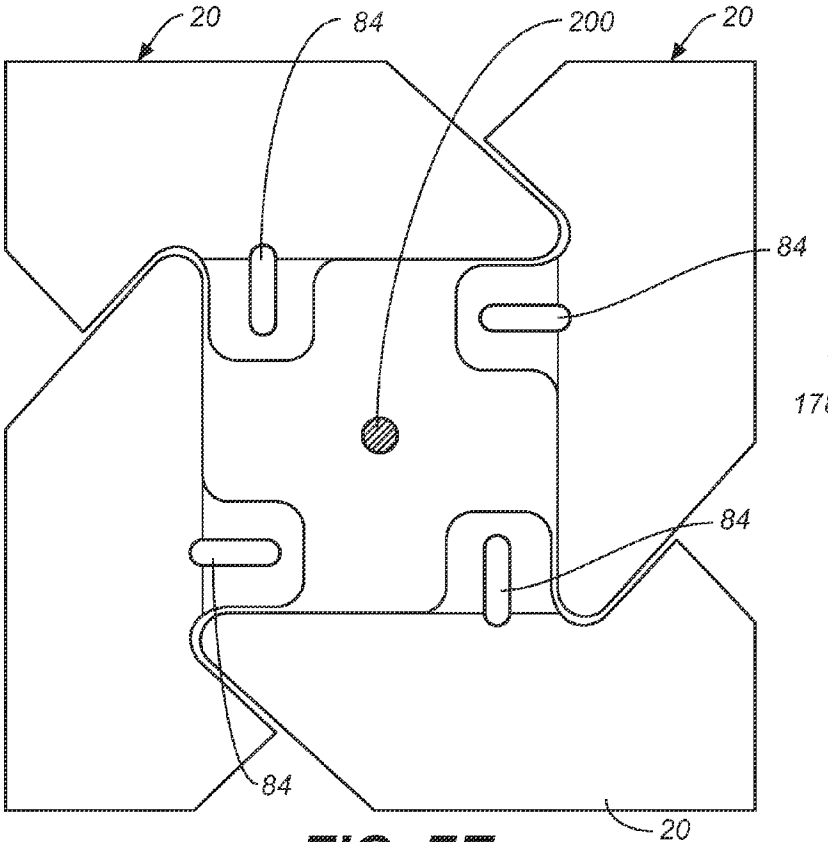
FIG. 7E is a top plan view showing a column assembly before the installation of the corner plate of 7A.

FIG. 7E is a top plan view showing a column assembly before the installation of the corner plate of FIGS. 7A-D. FIG. 7F shows the column of FIG. 7E after installation of the intact corner plate of FIG. 7A. The tabs 178 are bent for insertion into alignment slots 84 and anchor (or threaded extension bolt) 200 is disposed through center hole 171. The bolt holes 170 are shown arrayed alongside cuts 173.

Figure 7H:
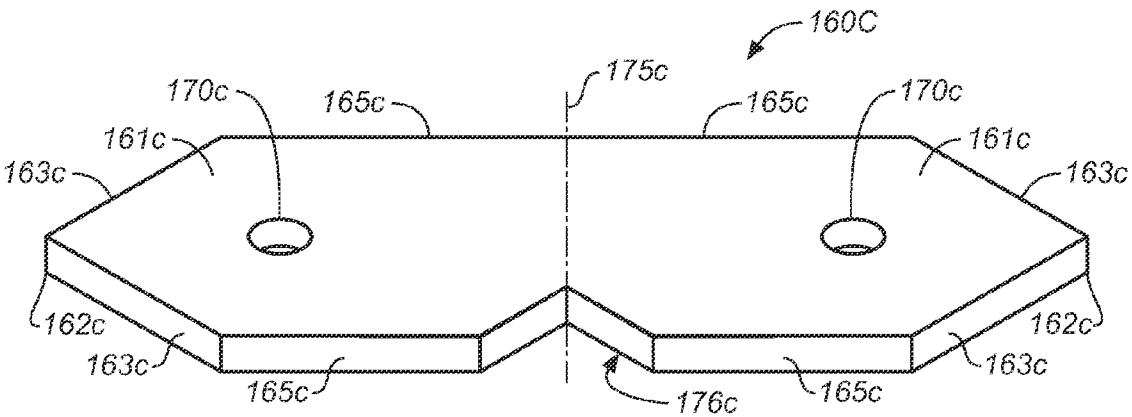
FIG. 7H shows an alternative corner plate.
Figure 7G:
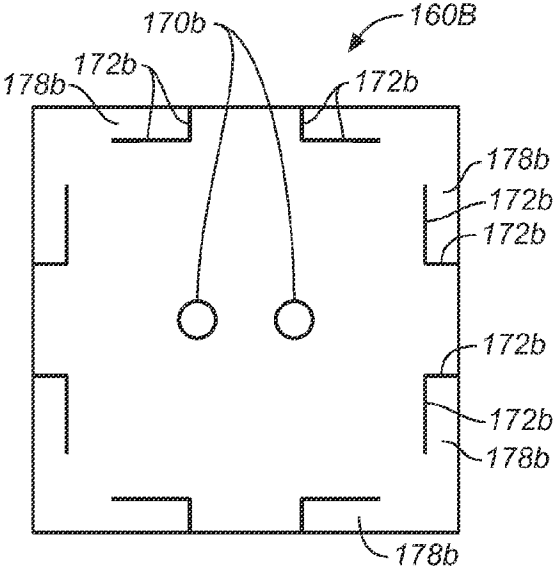
FIG. 7G shows an alternative bolt plate.

Alternative corner plate configurations are possible, as is shown in FIG. 7G. In this bolt plate design 160B, fold up/fold down tabs 178*b* are provided by slots 172*b* that facilitate folding for insertion either up or down into alignment slots according to the orientation of the stacked units in the particular bolting course. This plate also includes an alternative arrangement of bolt holes 170*b*.

FIG. 7H shows still another alternative corner plate 160C. This design is used only on bond strap courses and includes a rectangular body portion 160*c* with two triangular end portions 161*c*, each having an end vertex 162*c* with a 90 degree angle joining two sides 163*c* each angled 45 degrees relative to their respective outside edges 165*c*. This singular hardware piece is positioned in the same way that the triangular plate of FIGS. 7C-7D is positioned. Punched bolt holes 170*c* are positioned on the longitudinal centerline on each side of the transverse midline 175*c*. A triangular cut 176*c* on one side at the midline facilitates placement toward the inside portion of a corner (closest where the masonry unit sides converge).

Figure 8:
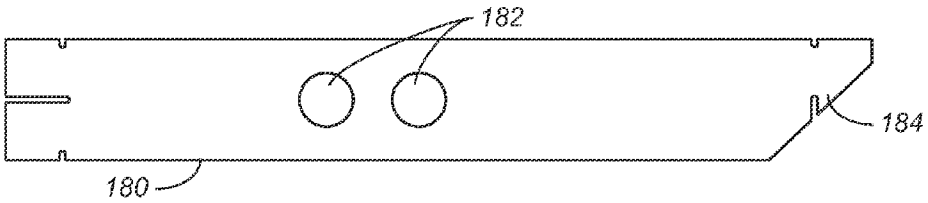
FIG. 8 is a top plan view of an end tie strap.

Next, and referring now to FIG. 8, the hardware system includes elongate end tie straps 180, preferably 1½"×8¼"× 16 gauge galvanized sheet metal end straps with pre-punched holes 182 disposed longitudinally along a center line, and tabs 184 for ends and corners.

Figure 9B:
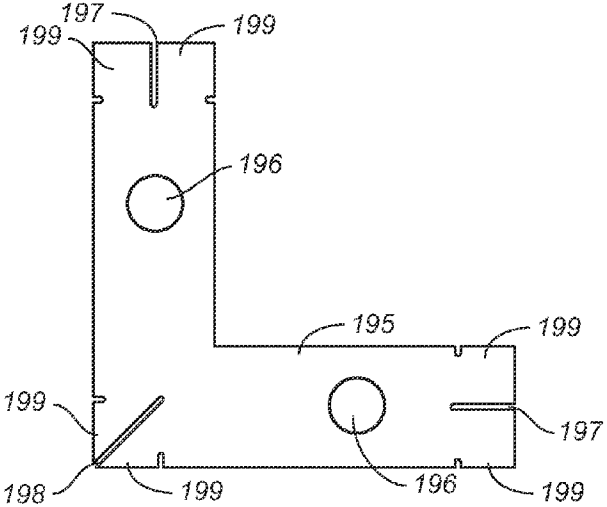
FIG. 9B is a top plan view of a corner el that may used instead of the corner unit of FIGS. 7A-D to secure a corner unit in a wall.
Figure 9A:
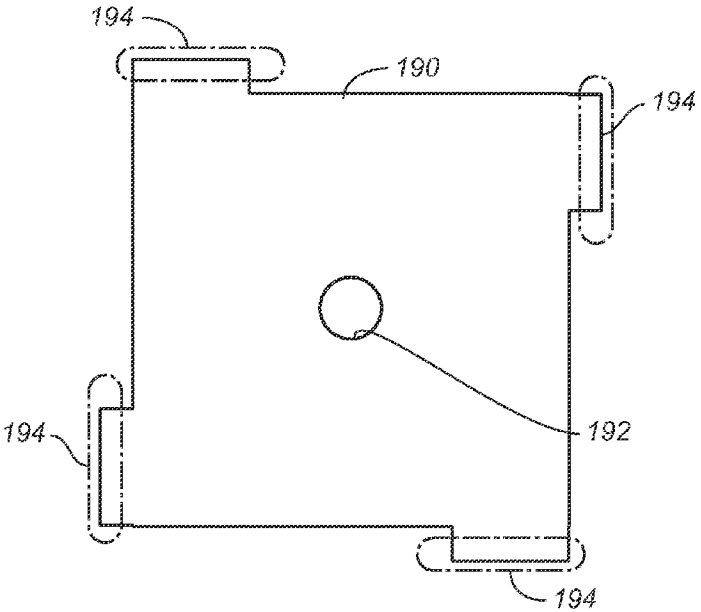
FIG. 9A is a top plan view of a column bolt plate.

Next, as seen in FIG. 9A, the hardware system includes column plates 190, preferably 5 7/16"×10 gauge square galvanized sheet metal plates with a pre-punched center hole 192 and tabs 194 disposed on each side proximate a corner.

Finally, as seen in FIG. 9B, it will be clear that an alternative to the corner plates shown in FIGS. 7A-D may be employed. This comprises a simple plate el 195 may be employed for securing corner units to wall units in an assembly. The el includes bolt holes 196, and may further include end cuts 197 and a corner cut 198 for forming tabs 199 suitable for insertion in block slots, as needed. Use of this el obviates the need to carve a recess in the wall unit, as is required when using the corner plate, as shown in FIG. 12A.

As can be seen by reference to FIG. 1 and FIGS. 11-12B, the fundamental stacking orientation of adjoining blocks in any given course is simply end-to-end abutment. That is, the blocks are merely pushed together into an abutting relationship by sliding the wing of one block into the female concavity of an adjoining block, at which point they cannot be further approximated. If both blocks are wall units, each block "interlocks" with the other inasmuch as a wing of each block is inserted into a female concavity of the adjoining block. With the wall units in this orientation, they also cannot be translated radially, i.e., rotated, and this prevents gross misalignments or an accumulation of successive small misalignments that add up to a grossly misaligned wall. However, the blocks (at least when looked at as simple pairs) could possibly be separated by translating them laterally, which is to say, apart. Furthermore, end and corner units may still be subjected to radial translation, and this is where the inventive hardware plays its essential role.

The hardware system employed in the present invention provides structural integrity where it is needed the most, namely, the lower portion of the wall. At the same time it still provides the flexibility of eliminating the cost and time required to employ all of the structural elements the full height of the wall. One unique feature of the hardware system is that it enables users to bolt the lower courses of blocks on a different spacing schedule than the higher courses of blocks. For instance, bolts can be provided every eight inches on center, if needed for the lowest course or courses, but bolts can be placed at 16 inches on center in the middle courses, and 32 inches on center for the highest courses. Accordingly, for the smaller brick designs, anchor bolt spacing can begin as tight as eight inches on center and progress to sixteen or thirty-two inches on center, if desired. For larger block designs, spacing can begin at twelve inches on center and progress to twenty-four or forty-eight inches on center.

The hardware system further ensures unit alignment front to back while tying the wall from end to end at a predetermined height (e.g., every two feet in height) as the wall units are stacked. This method permanently secures the units at reasonable intervals for ease of construction.

A differential spacing schedule for vertical anchor bolts can be seen in FIG. 10, which shows the kind of grid-like scaffolding that the anchor bolts 200, bond straps 130, and bolt plates 140/146 provide when erected atop a poured-in-place concrete footing 202. The means for securing anchor J-bolts in a concrete wall footing is well known in the art and need not be described herein. Upper courses of bolts are simply inserted straight end first through the bolt hole of a lower bond strap and then through the bolt hole in the bond strap immediately above and secured with a nut until the bend in the anchor engages the lower bond strap.

Construction Method: What follows is a more detailed explanation of the method steps in constructing a wall using the novel blocks shown in the instant application.

Footing: As may be surmised from the foregoing description of the system units and hardware, the inventive masonry wall system preferably rests upon a poured-in-place concrete footing. The width and depth of this footing will vary with the height and function of the wall. Free standing landscape fencing will require a lesser footing than a retaining wall of the same height, but in either case the inventive dry stack system is not intended to exceed more than six feet in height. However, standard engineering of the footing design may be provided for given wall heights with site-specific engineering provided by a qualified structural engineer.

Wall layout, footing size and elevations are determined in advance of excavation. Once below grade footing excavations have been completed, long reinforcing steel with stirrups, if required, should be laid in the bottom of the footing on wire chairs, such as Simpson Strong Tie WRC3.

The inventive dry stack system preferably sits on an eight inch wide curb. Anchor bolt layout may be provided pursuant to engineering specifications. The brick design may have anchor bolts as close as eight inches on center, and this close schedule may be required for some retaining wall. In every instance, the anchor bolts are placed according to the available spacing of the pre-punched holes in the bond strap.

Preferably the concrete footing has a curb height at finish grade and requires only that the top of the curb be struck off level for finishing. Anchor bolts are held plumb and to the correct height, viz., one inch minimum above the first prescribed bond strap height. Anchor bolts are embedded at a depth of at least the bottom reinforcing steel.

First Course: After the concrete footing has cured and any form work removed, the first course can be laid out. Surface irregularities or debris, such as pebbles. on the top of the curb are removed. Beginning at one end or corner, the terminal unit is placed followed by wall units alternating front to back until the opposite end is reached. The first course of wall units is laid with the top side down, thus presenting a generally planar surface on which the second course will be laid. With the recessed areas down these units will face fewer irregularities. Wall units mate to interlock around the anchor bolts with the rounded corner of one block inserted into the female concavity of an adjoining block such that a space 210 is defined between the back sides of adjoining blocks, and it is through these spaces that the vertically disposed anchors bolts extend. See FIGS. 11B and 12B.

When the opposite end or corner of the wall is reached, the end or corner unit is placed with the top either up or down so that it mates with the last wall unit. A dry line is pulled from end to end and the original layout marks the height of the block above the curb. Wall alignment is checked using the dry line from end to end and from front to back with a good hand level. Adjustments are made as needed and two to four courses are stacked at each end tapering down, as if building the wall from the ends toward the center.

In the event the wall cannot be adjusted to level properly from front to back, triangular shims of twenty four gauge galvanized sheet metal can be used on the low side. These one and one half right angle shims can be placed adjacent the anchor bolt where the bearing area provides the greatest cross sectional overlap. Voids larger than a few thicknesses are preferably filled with mortar.

Figure 12B:
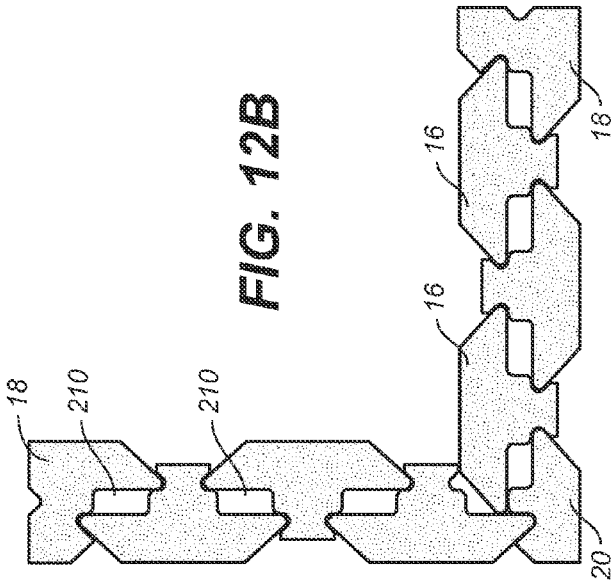
FIG. 12B is a bottom view of the adjoining walls of FIG. 12A.
Figure 12A:
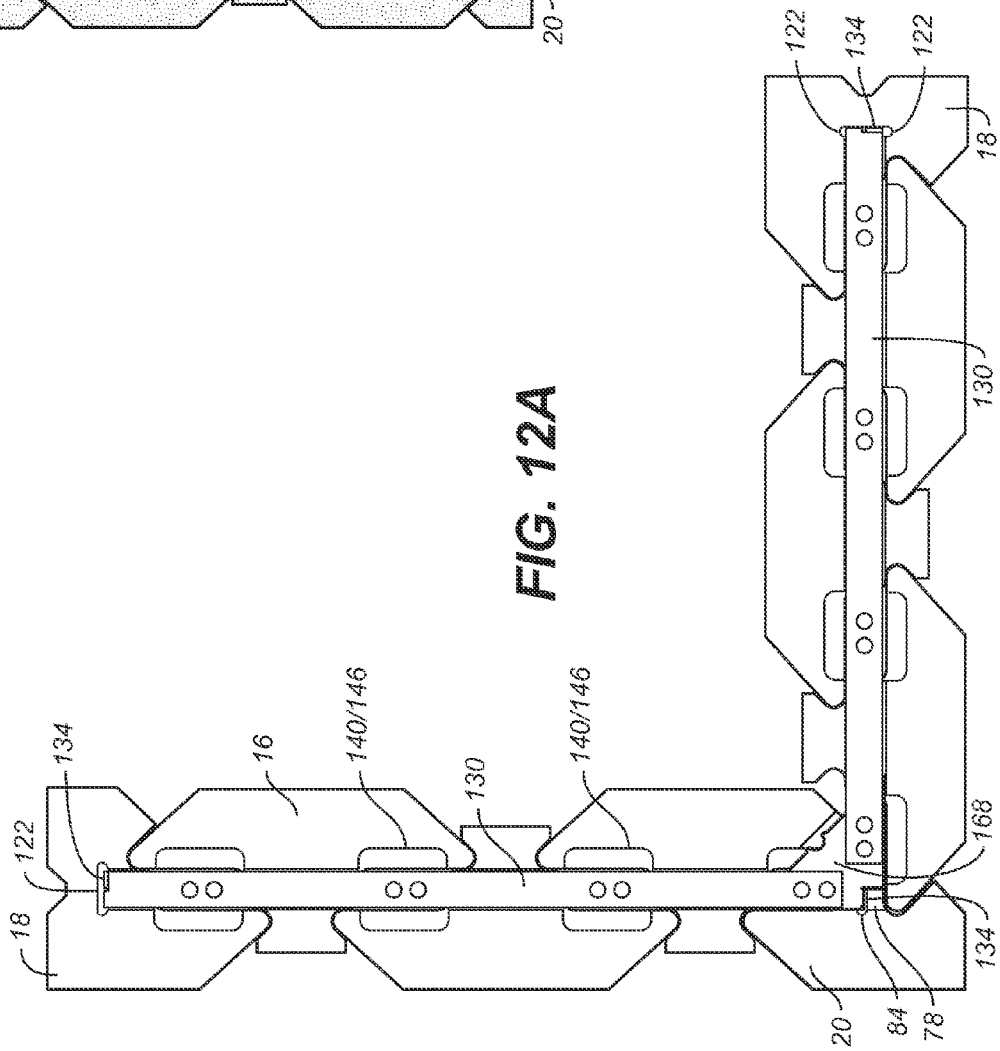
FIG. 12A is a top plan view of the block and hardware configuration for two walls joined at a 90 degree corner.

FIGS. 12A-12B show how corner units 20 are abutted to adjoining wall units 16, and how the inventive hardware elements are installed, including the bond strap 130 and bolt plates 140/146, as well as how the bolt strap tabs 134 are inserted into both corner slots 84 and wall end unit slots 122. As will be appreciated, the male wing portion of the wall unit that abuts corner unit 20 must be shaved down slightly so as to make that portion substantially coplanar with the upper surface of projection 78, and thereby to accommodate a split corner plate half 134 installed at the end of the perpendicular bond straps 130.

In some applications, the first course may need to be set in mortar. When this is necessary, the highest point in the curb is identified and the mortar is laid slightly higher. A dry line is used to establish alignment and to make certain the units are level from front to back. Dry stacking is continued up to four courses at each end tapering down toward the center.

Once alignment of the first course is confirmed, added courses are removed at each end. End tie straps or triangular corner ties (preferably sixteen gauge galvanized) are installed with the tabs bent up or down as needed for insertion into a slot in the end or corner block. The recessed slot is then preferably filled with masonry adhesive, which is typically provided in tubes which can be applied in small controlled amounts, squeezed from a hand held gun. The adhesive is not used to glue the courses together but to fill the void in the recessed slot and to lock the unit's position relative to the sheet metal tab once the adhesive is cured. Two more courses are then stacked at each end or corner as before and the required ties are installed.

Installation of the triangular corner plate (FIGS. 7C-7D) or the alternative corner plate design (FIG. 7H) requires the top of the adjacent wall unit be cut for a recess. This is the only location where any units need to be cut and it is done for the sole purpose of creating a physical tie between the first anchor bolt in each direction of the wall.

Second Course to Bond Strap: When ready to install a second course, first the vertical alignment of the units is checked in each direction and at each end with a hand level. Once this is confirmed, a mason's block is used to hold the dry line and re-establish the line from end to end or corner to corner at the top edge of the second course. The second course is laid while checking alignment along the length of the wall. A hand level is used to check level from front to back as needed. Wall alignment with the dry line is checked to ensure that front-to-back level is satisfactory. The third course is laid after raising the dry line to the top edge of the third course.

Shimming is employed only as required to maintain alignment with the dry line or to maintain plumb. If a mortar bed was required for the first course, it may be best to allow the mortar to set over night. Dropping in a select few bolt plates and hand threading nuts over the anchor bolts will secure the low wall overnight. Three eight inch high courses bring the wall to bond strap height if 24 inch anchor bolts are employed, while three inch high brick units may have several courses to go before the bond strap would bolt the assembly down.

Bond Strap to Bond Strap: As noted previously, generic engineering can provide bond strap intervals at prescribed heights for given wall applications and conditions. This is true also for any change or reduction in the bolting pattern requirements.

Bolting the wall at each prescribed bond tie accomplishes three important functions. First, it applies the greatest structural strength where it is most needed—namely, the lower portion of the wall. Secondly, the hardware secures the wall in its proper position while under construction. And thirdly, it obviates the need for bolting higher in the wall. Site specific conditions or special engineering may require the lower courses to be fully grouted for seismic codes or greater structural integrity. This can be achieved by pouring grout into the voids prior to installing bond straps.

After setting over night, if needed, the vertical plumb of each end or corner in each direction is checked. The dry line is reestablished and the wall alignment checked end to end. Units are leveled front to back using shims only as needed.

The next course is built up at each end as before and end and corner ties are installed and embedded in masonry adhesive. The dry line is raised to the next course and the next course is then laid. Alignment is again checked. This sequence is repeated until the course level is within one course of the first bond strap. The end of anchor bolts must be at least one inch above the top of the next course. The correction of one or more anchor bolts may be achieved with a coupling nut, such as the Simpson CNW⅝. If a more radical correction is necessary, lowering the bond strap by one course is always possible.

At bond strap height, bolt plates are dropped in over the anchor bolts using the holes punched in the bolt plates. Bolt plates fit into the recess on the back edges of the male wing elements on the units. The bond straps can be provided in any length, though standard 113" lengths are preferable. As described above, each end is slotted to create and provide tabs that can be bent up and down to fit into the recessed slots of the block units. Starting at one end, the bond strap is laid into the recess at the top of wall and end units. The hole pattern provided matches the bolt pattern and locks in the alignment of units front to back. The bond strap when placed rests atop the bolt plates. Alignment of the wall is regularly checked against the dry line as additional straps are laid down the length of the wall. Each bond strap should overlay the previous strap by at least one anchor bolt.

At the opposite end the bond strap may be cut to length with a slot added to allow for bent tabs. With the bond straps laid in place from end to end, hole alignment is checked and confirmed for the threaded holes in the bolt plate (if the threaded hole embodiment is used) in relation to the holes in the bond strap. Each end is also checked for vertical alignment or plumb. Wall alignment with the dry line and also checked and nuts are threaded onto all anchor bolts when ready. Nuts are tightened to a predetermined torque setting, and threaded extension rods are installed in the threaded hole at the specified spacing using properly secured bolt plates. Wall end vertical alignment and alignment down the length of the wall are rechecked and stacking of the next course is started.

Since end units alternate with the recessed top to the bottom to mate with the ends of wall units, it is possible that the final block is set top down, which prevents the bond strap from connecting to the end of the course. In such a case, the end anchor bolt can be secured at the lower course with bolt plate and end tie strap, then torque tightened to a specified setting. A threaded extension rod is then added at this level and the same condition will be repeated at the next bond strap. This will secure the end of the wall. A similar situation may arise at a corner, and a similar solution is provided. However, corners do not require bolt plates but use coupler nuts and may require the anchor bolt or extension rod to be cut to the correct length.

Cap Course: Once the number of courses is laid to bring the wall to its designed height and the last bond strap is in place, the top course is set with the top down. This constitutes the cap course, and it is secured, sealed, and protected from the elements by filling the anchor bolt cell with grout. The end units may have the slotted recess filled with masonry adhesive to secure them to the bent tabs of the bond strap as well, but once the grout has cured it will lock the ends and corners into position. If desired, several flat wall caps can be added to provide a decorative finish. These caps can be secured with masonry adhesive in a manner well known in the art.

Square Columns: Referring next to FIGS. 7E-7F, it will be seen that by using the intact square corner plate of FIGS. 7A-7B, a square free standing column can be erected. This assembly requires four corner units 20 assembled in a square and joined by an undivided corner plate 160 with the corners slotted 172 for bent tabs. The anchor bolt 200 is located and secured at the center of the column. The tabs on the bolt plate are bent up and down in the same fashion as wall corners, inserted into slots 84 in the corner units, and installed with masonry adhesive to fill the voids left after inserting the tabs into the slots. Again, the adhesive is only provided as a means to permanently lock the unit position, not to glue it down. Additional structural integrity may be gained by fully grouting the interior cell prior to bolting the assembly to the specified torque setting.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A masonry block and hardware set for use in dry stack construction of walls and columns, comprising:

a plurality of wall units;

a plurality of corner units;

a plurality of end units wherein each of said wall, corner, and end units have a top surface with a depression that is brought into substantial alignment when an adjoining block at the same level or in the same course is abutted with the respective unit, and further wherein when any two of said units are adjoined, said units create a vertically oriented space for accommodating clamping hardware, and further wherein each of said end and corner units include an alignment slot to align said end units and said corner units in relation to adjoining wall units;

wherein each of said wall units, said end units, and said corner units include a bottom side, a front face, a back side, at least one wing portion, and at least one female concavity for receiving a wing portion of an adjoining block, wherein when any two of said units are abutted so as to bring a wing element into mating engagement with a concavity in an adjoining unit, said abutted units define a vertically disposed hole for passing a vertically disposed anchor bolt connected to ground or a poured-in place footing;

wherein each of said wall units, said end units, and said corner units include a rectangular depression in said top surface in a rear area of said wing portion, such that when any two of said units are abutted so as to bring a wing element into mating engagement with a concavity in an adjoining unit, said abutted units define a recessed platform for accommodating a square bolt plate having holes for disposing said bolt plate over an anchor bolt;

hardware received in the aligned depressions and in the vertically oriented space for clamping the units in place as wall construction proceeds, wherein the clamping provides a downwardly directed compressive force and lateral rigidity;

wherein said hardware includes anchor bolts, bond straps, bolt plates, and tie straps;

wherein said bolt plates include medial bolt plates for positioning on and between wall units or wall and end units, and corner bolt plates for positioning on and between corner units and wall units;

wherein said medial bolt plates comprise a generally planar square metal plate having one unthreaded hole and one threaded hole; and wherein said corner bolt plates comprise a generally planar square metal plate with a center hole and diagonal cut slots defining frangible lines which facilitate breaking the plates in half to form two discrete right triangle halves, each of said halves including two pre-drilled holes for passing bolts, crimps and diagonal cuts at the vertices to form tabs that enable easy bending of the vertices for insertion into said alignment slots of said corner units.

2. The masonry block and hardware set of claim 1, wherein said bolt plates further include substantially planar square metal column plates having a center hole and bendable tabs disposed on each side proximate a corner.

3. The masonry block and hardware set of claim 1, wherein said wall unit further includes a top surface covering all of said male and female body portions and including a first depression in said top surface of said rear area of each of said wings and a second depression on the top surface of said base area, wherein the depth of the depressions in said wings is greater than that of the depression in said base portion.

4. A method of constructing a dry stack masonry wall, comprising the steps of:

(a) providing a masonry block and hardware set that includes a wall unit, a corner unit, and an end unit, wherein each of said wall, corner, and end units have a top surface with a depression that is brought into substantial alignment when an adjoining block at the same level or in the same course is abutted with the respective unit, and further wherein when any two of said units are adjoined, said units create a vertically oriented space for accommodated clamping hardware, and further wherein each of said end and corner units include an alignment slot to align said end units and said corner units in relation to adjoining wall units, and hardware received in the aligned depressions and in the vertically oriented space for clamping the units in place as wall construction proceeds, wherein the clamping provides a downwardly directed compressive force and lateral rigidity;

(b) determining wall layout, footing size, elevations, and bond strap levels;

(c) excavating ground for a below grade footing;

(d) laying reinforcing steel with stirrups on wire chairs in the excavation;

(e) connecting vertically disposed anchor bolts to the reinforcing steel in a predetermined lower course spacing schedule, held plumb to a height above the first prescribed bond strap height and embedded at a depth of at least the bottom reinforcing steel;

(f) pouring an in-place concrete footing;

(g) laying a first course either top side up or down according to plan by beginning with an end or corner unit, followed by two wall units alternating front to back in an end-to-end abutment orientation by sliding the wing of one block into the female concavity of an adjoining block and continuing in this manner until the end or corner of the wall is reached, thereby presenting a generally planar surface on which to lay a second course, mating wall units to interlock around the vertically disposed anchor bolts with the rounded corner of one block inserted into the female concavity of an adjoining block such that a space is defined between the back sides of adjoining blocks;

(h) placing a corner or end unit when the opposite end of the wall is reached, placed with the top either up or down so as to mate with the last wall unit;

(i) installing either end tie straps or triangular corner ties with tabs bent up or down as needed for insertion into a slot in the end or corner block;

(j) cutting a recess in the top of the adjacent wall unit recess if a triangular corner tie is employed to create a physical tie between the first anchor bolt in each direction of the wall;

(k) installing subsequent courses while routinely checking vertical and horizontal alignment until bond strap height is reached;

(l) when the first prescribed bond strap height is reached, placing bolt plates over the anchor bolts using the holes punched in the bolt plates and positioning the bolt plates into the recess on the back edges of the male wing elements on the masonry units;

(m) placing bond straps over the bolt plates and in the recess on the base portion of the masonry units, bending the end tabs of the bond strap for insertion into the alignment slots in the corner and/or end units and ensuring that each bond strap overlay any adjoining strap by at least one anchor bolt;

(n) cutting the bond strap to length as need and adding an end slot added to allow for bent tabs;

(o) threading nuts over anchor bolts and tightening to a predetermined torque setting;

(p) installing threaded extension rods in the threaded hole of the bolt plate in a predetermined spacing schedule;

(q) routinely checking wall end vertical alignment and alignment down the length of the wall before each new course is started; and (r) laying the cap course.

5. The method of claim 4, wherein step (p) entails placing threaded extension rods in the same spacing schedule as that of the anchor bolt schedule.

6. The method of claim 4, wherein step (p) entails placing threaded extension rods in at least one row of hardware in a spacing schedule different from that of the anchor bolt schedule.

7. The method of claim 4, further including the step of (s) filling one or more anchor bolt cells with grout.

8. The method of claim 4, further including the step of (t) filling end unit alignment slots with masonry adhesive to secure them to the bent tabs of the bond strap.

* * * * *